US006302378B1

(12) United States Patent
Koch et al.

(10) Patent No.: US 6,302,378 B1
(45) Date of Patent: Oct. 16, 2001

(54) DOUBLE POSITIVE RELEASE SNOWMOBILE JACK

(76) Inventors: Donald J. Koch, 116 Rice St., Stockbridge, MI (US) 49285; Ronald Koch, 7690 Grand, Dexter, MI (US) 48130

( * ) Notice: Subject to any disclaimer, the term of this patent is extended or adjusted under 35 U.S.C. 154(b) by 0 days.

(21) Appl. No.: 09/559,699

(22) Filed: Apr. 27, 2000

Related U.S. Application Data

(63) Continuation of application No. 09/070,584, filed on Apr. 30, 1998, now abandoned.
(60) Provisional application No. 60/045,247, filed on May 1, 1997.

(51) Int. Cl.[7] ..... B66F 3/00
(52) U.S. Cl. ..... 254/131
(58) Field of Search ..... 254/113–119, 120, 254/130, 131

(56) References Cited

U.S. PATENT DOCUMENTS

| | | | | |
|---|---|---|---|---|
| 268,790 | * | 12/1882 | Goodwin | 254/130 |
| 425,785 | * | 4/1890 | Hall | 254/129 |
| 658,939 | * | 10/1900 | Benton | 254/129 |
| 677,920 | * | 7/1901 | Babbitt | 254/129 |
| 750,287 | * | 1/1904 | Kimberly | 254/130 |
| 758,773 | * | 5/1904 | Parker et al. | 254/129 |
| 1,349,195 | * | 8/1920 | Flohr | 254/117 |
| 5,135,200 | * | 8/1992 | Kirk | 254/114 |

* cited by examiner

*Primary Examiner*—Robert C. Watson
(74) *Attorney, Agent, or Firm*—James M. Deimen

(57) ABSTRACT

A new snowmobile jack that does not require the hands or fingers of the user to be anywhere near the jack when raising and lowering the snowmobile. The jack comprises a T-bar that moves telescopically vertically to support a rear handle/tow bar on a snowmobile. A mechanical linkage operated by a first foot pedal raises and lowers the T-bar. A second mechanical device on the jack includes a positive latch operated by a second foot pedal. The latch positively prevents the first foot pedal and linkage from lowering the T-bar. Both foot pedals must be simultaneously depressed to release the latch and allow the T-bar to descend. The simultaneous action with two feet makes very unlikely any inadvertent lowering of the jack and obviates the need for the user to reach down to the jack with the hands.

10 Claims, 2 Drawing Sheets

DOUBLE POSITIVE RELEASE SNOWMOBILE JACK

This application is a continuation of application Ser. No. 09/070,584 filed Apr. 30, 1998 now abandoned, in turn claiming the benefit of provisional patent application No. 60/045,247 filed May 1, 1997.

BACKGROUND OF THE INVENTION

The field of the invention pertains to jacks for raising vehicles and, in particular, to manually operated jacks for raising and supporting the rear of a snowmobile.

A variety of jacks and stands have been marketed for raising and supporting bicycles, motorcycles, snowmobiles and other similar vehicles. Such devices generally include a horizontal member that fits underneath the frame of a bicycle or motorcycle. For snowmobiles, the rear handle or tow bar is solidly attached to the frame and therefore a jack or stand can supportingly be fitted thereto. For safety reasons the snowmobile jack or stand must be very stable because users frequently operate the engine and endless track with the snowmobile raised.

Snowmobile stands generally require that separate devices be used to raise the snowmobile or that the snowmobile be "rocked" up onto the stand. The stands use a horizontal "U" shaped channel to fit under the rear handle/tow bar. Some stands are height adjustable and include debris shields to intercept snow and ice that flies off the moving endless track.

Snowmobile and motorcycle jacks generally include a manually operated handle or foot pedal to raise and lower the horizontal member that engages the rear handle/tow bar. Such jacks use a mechanical linkage to raise and lower the horizontal member. Alternatively, an adjustable strap and hook may be used as a part of the mechanical linkage. Overcentering linkages or pins may be incorporated in the linkages to retain the jack and snowmobile in the raised position.

Since snowmobiles are frequently operated while raised on a jack, assurance that the jack does not slip or drop is of paramount safety importance. Further, it is preferable that a jack be foot operated to keep fingers away from the jack mechanical linkage. With a view toward providing a more positively latched, foot operated snowmobile jack, applicants have developed the device disclosed below.

SUMMARY OF THE INVENTION

The new snowmobile jack comprises a T-bar that moves telescopically vertically to support a rear handle/tow bar on a snowmobile. A mechanical linkage operated by a first foot pedal raises and lowers the T-bar. A second mechanical device on the jack includes a positive latch operated by a second foot pedal. The latch positively prevents the first foot pedal and linkage from lowering the T-bar. Both foot pedals must be simultaneously depressed to release the latch and allow the T-bar to descend. Thus, the jack does not require the hands or fingers of the user to be anywhere near the jack when raising and lowering the snowmobile. To lower the jack simultaneous action with two feet is required, thereby making very unlikely any inadvertent lowering of the jack. It is also much easier for the user to use both feet than to reach down to the jack with the hands.

DESCRIPTION OF THE PREFERRED EMBODIMENT

Figure 1:
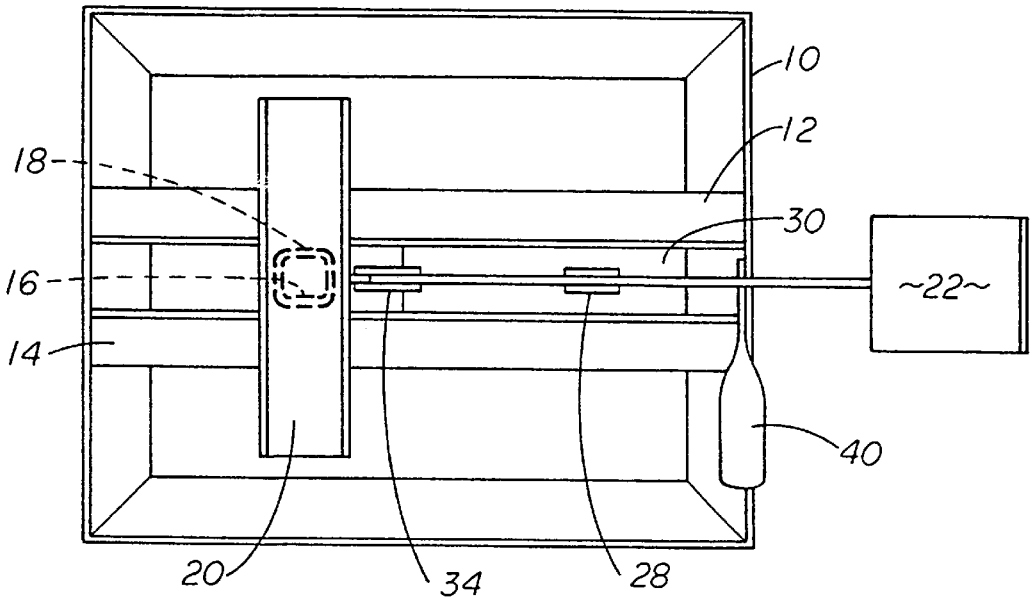
FIG. 1 illustrates in plan view the new snowmobile jack.
Figure 2:
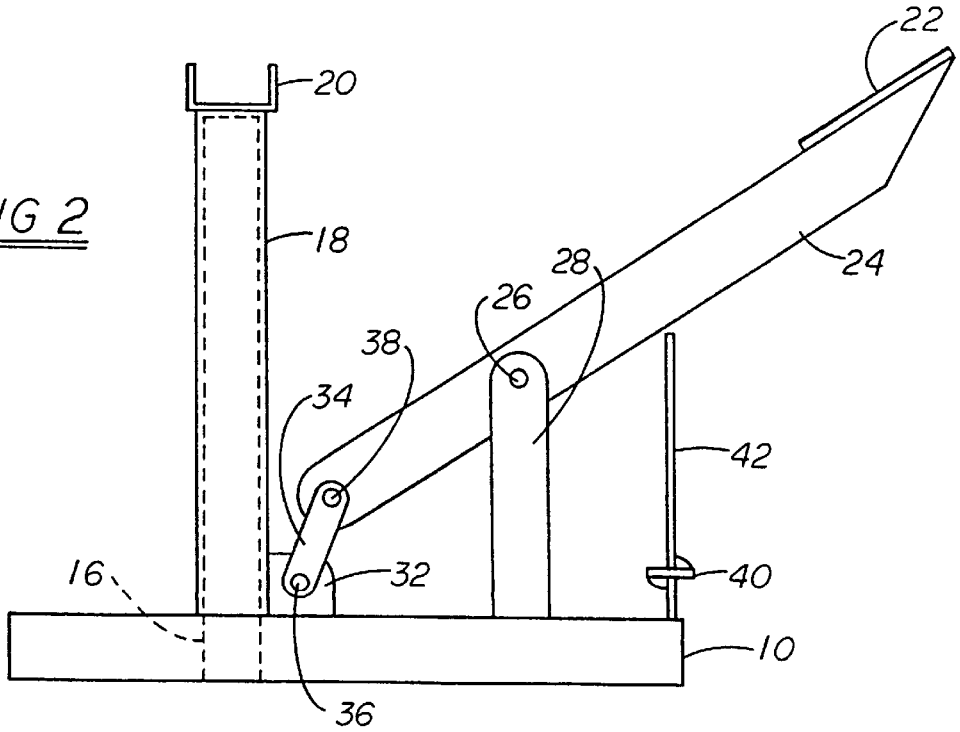
FIG. 2 illustrates in side view the new jack in lowered position.

In FIGS. 1 and 2, the new snowmobile jack comprises a rigid rectangular base 10 constructed of angle irons or similar material. A pair of angle irons 12 and 14 extend across the base 10 to either side of the base longitudinal centerline and are permanently fastened to the base. The angle irons 12 and 14 are spaced apart to accept a vertical square tube 16 that is permanently attached to the angle irons 12 and 14. The vertical square tube 16 serves as the inside member of a telescopic support, the outside member being a square tube 18 that can slide vertically on the inside tube 16. Atop the vertically moveable square tube 18 is a horizontal U-shaped channel 20 permanently attached to tube 18.

In constructing the jack the permanent attachments are preferably weld which can be very economically made with steel or structural aluminum components. Other means of fastening the components together such as mechanical fasteners may be substituted.

The U-shaped channel 20 is adapted to engage the rear handle/tow bar of a snowmobile and by raising the square tube 18 on the square tube 16 the snowmobile rear end is raised. To raise and lower the square tube 18, a first foot pedal 22 operated linkage is employed. The first foot pedal is permanently fastened to a lever bar 24 which in turn is rotatably pinned to a horizontal fulcrum 26. The fulcrum 26 is supported by a pair of vertical plates 28 on either side of the lever bar 24. The pair of vertical plates 28 are permanently fastened to a horizontal plate 30 in turn permanently fastened to the pair of angle irons 12 and 14.

Permanently fastened to the lower end of the square tube 18 is a bracket 32. A pair of links 34 are rotatably pinned at 36 and 38 to the bracket 32 and end of the lever bar 24 opposite the first foot pedal 22. Thus, by stepping on the first foot pedal 22 the square tube 18 and channel 20 can be raised as shown in FIG. 3.

Figure 3:
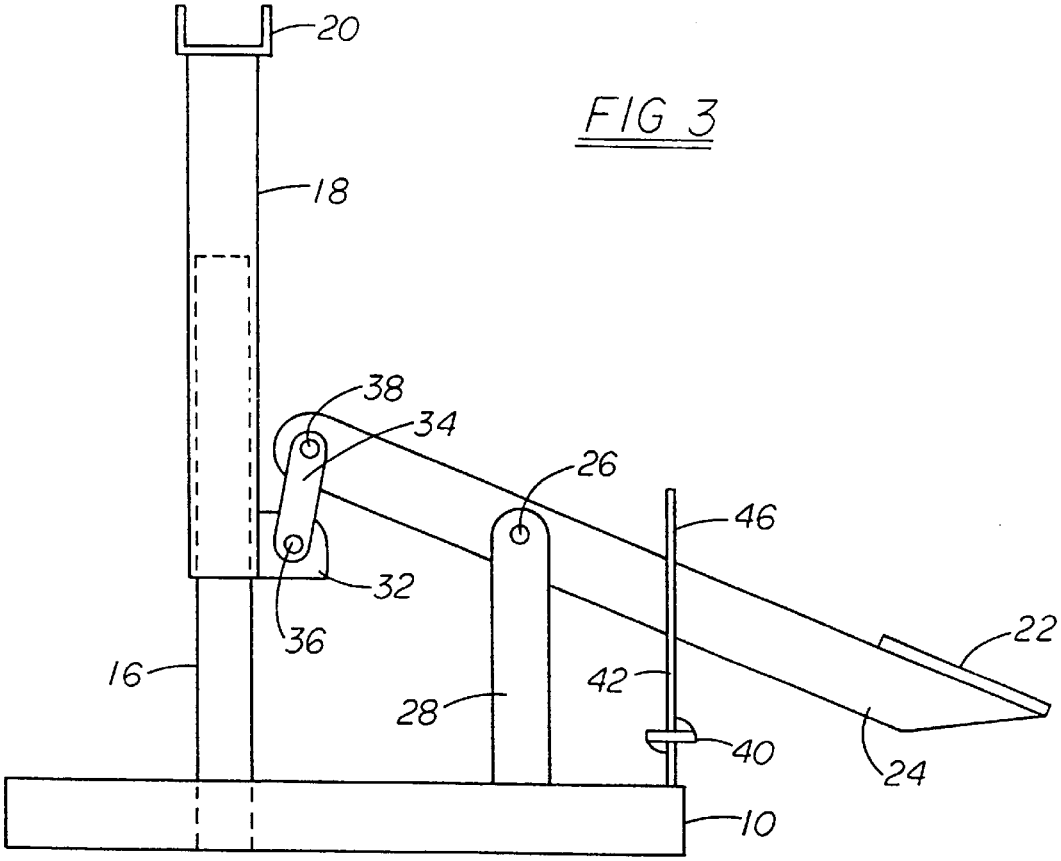
FIG. 3 illustrates in side view the jack in raised position.

To latch the jack in the raised position of FIG. 3, a second foot pedal 40 operated rotatable plate 42 is employed. The plate 42, as best shown in FIG. 4, is rotatable about a fulcrum pin 44 on the base 10 and has the second foot pedal 40 formed as an integral part of the plate 42.

The top of the plate 42 is formed into a hook 46 shaped to fit over the lever bar 24 when the lever bar is in the position shown in FIG. 3 with the jack raised. The weight of the snowmobile on the jack retains the lever bar 24 fully engaged with the hook 46. Even if the second foot pedal 40 is stepped on, the hook 46 will not release the lever bar 24. Only if the first foot pedal 22 is simultaneously stepped on, slightly raising the jack and snowmobile further, can the hook 46 be released allowing the plate 42 to rotate counterclockwise, and the jack and snowmobile be lowered.

Figure 4:
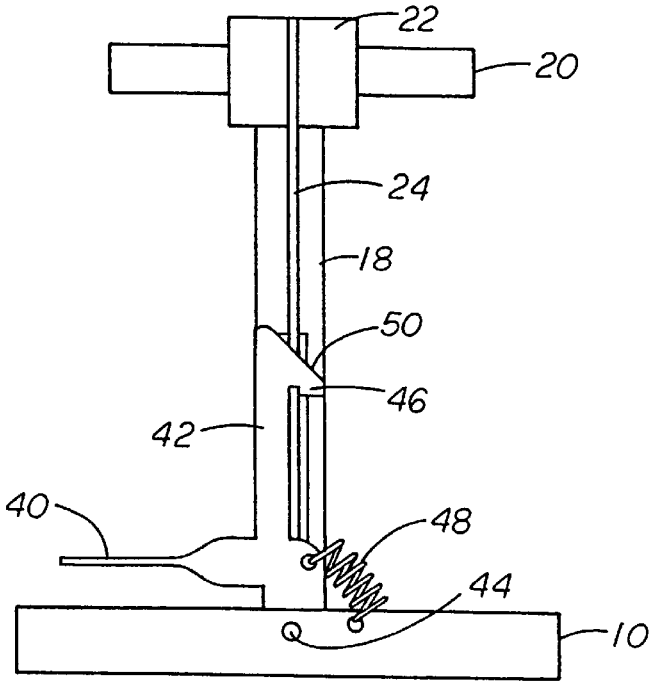
FIG. 4 illustrates in end view the jack in lowered position.

A small spring 48 urges the plate 42 and hook 46 into the position shown in FIG. 4. When the first foot pedal 22 is stepped on to raise the jack, the lever bar 24 strikes the sloped part 50 of the hook 46 rotating the plate 42 counterclockwise until the lever bar 24 clears the hook 46 whereupon the spring 48 causes the plate 42 to return to the position shown in FIG. 4 and fully engage the hook 46 with the lever bar 24 upon release of the first foot pedal 22.

Preferably, the second foot pedal 40 is located sufficiently close to the base 10 to enable a user to operate the pedal 40 with the left foot while standing on the left heel and operating the right foot pedal 22 with the right foot.

We claim:

1. A mechanical jack comprising a base positionable on a floor, vertically raisable means on the base and means to engage a vehicle on said vertically raisable means;

a first foot pedal and a first foot pedal operated linkage attached to the base and operably connected to the vertically raisable means, a second foot pedal and a second foot pedal operated means attached to the base and having positive latching engagement means thereon, said positive latching engagement means being engageable and partially disengageable with the linkage by downward movement of the first foot pedal, said first foot pedal being positioned above said floor upon engagement with said positive latching engagement means, wherein upon engagement of the positive latching engagement means with the linkage, full disengagement cannot occur absent simultaneous downward actuation of both foot pedals.

2. The mechanical jack of claim 1 wherein the engagement means comprises a hook.

3. The mechanical jack of claim 1 wherein the vertically raisable means is telescopic.

4. The mechanical jack of claim 1 wherein the engagement means is urged into engagement position by a spring.

5. The mechanical jack of claim 1 wherein the second foot pedal operated means is movable in a plane perpendicular to the plane of movement of the linkage.

6. The mechanical jack of claim 5 wherein the linkage and the second foot pedal operated means each include a member rotatable about a fulcrum.

7. A mechanical jack comprising a base positionable on a floor, raisable means on the base and means to support a vehicle on said raisable means, a first foot pedal and a first foot pedal operated means operably connected to the raisable means, a second foot pedal and a second foot pedal operated means having positive latching engagement means being engageable and partially disengageable with at least one of the group consisting of the raisable means and the first foot pedal operated means by downward movement of the first foot pedal wherein upon engagement of the engagement means, said first foot pedal is positioned above said floor and full disengagement cannot occur absent simultaneous actuation of both foot pedals including; downward movement of the first foot pedal.

8. The mechanical jack of claim 7 including means urging the engagement means into position for engagement.

9. The mechanical jack of claim 8 including means to automatically displace the engagement means during raising of the raisable means.

10. The mechanical jack of claim 1 wherein said raisable means includes vertical telescopic means.

* * * * *